United States Patent [19]

Battie et al.

[11] Patent Number: 4,671,867

[45] Date of Patent: Jun. 9, 1987

[54] METHOD AND MEANS FOR TREATING FOUNDRY SANDS AND THE LIKE

[75] Inventors: Gabriel Battie, Andrezieux Boutheon; Yves Bonnel, Rive de Gier, both of France

[73] Assignee: Centre Stephanois de Recherches Mecaniques Hydromecanique et Frottement, France

[21] Appl. No.: 714,496

[22] Filed: Mar. 21, 1985

[30] Foreign Application Priority Data

Mar. 21, 1984 [FR] France ..... 84 04696

[51] Int. Cl.[4] ..... B03B 1/00; B03C 1/30; B07B 9/00; B22C 5/10

[52] U.S. Cl. ..... 209/3; 209/2; 209/40; 209/44; 209/214; 209/467; 241/DIG. 10; 164/5

[58] Field of Search ..... 209/12, 40, 44, 2, 214, 209/215, 466, 467, 474, 3; 241/DIG. 10; 164/5, 456

[56] References Cited

U.S. PATENT DOCUMENTS

| | | | |
|---|---|---|---|
| 2,348,344 | 5/1944 | Holmes | 209/467 |
| 2,452,362 | 11/1948 | Erisman | 241/DIG. 10 X |
| 2,635,753 | 4/1953 | McLean | 209/466 |
| 2,698,086 | 12/1954 | Vogel | 209/466 X |
| 3,446,355 | 5/1969 | Boucraut | 209/474 |
| 3,764,078 | 9/1973 | Richard | 241/DIG. 10 X |
| 4,144,088 | 3/1979 | Adams | 164/5 X |
| 4,354,641 | 9/1982 | Smith | 241/DIG. 10 X |
| 4,449,566 | 5/1984 | Filipovitch | 164/5 |

FOREIGN PATENT DOCUMENTS

| | | | |
|---|---|---|---|
| 109542 | 8/1980 | Japan | 164/5 |
| 58-97462 | 6/1983 | Japan | 164/5 |
| 933178 | 6/1982 | U.S.S.R. | 164/5 |

OTHER PUBLICATIONS

Combustion Engineering Cast Products, Technical Bulletin SR-110, Jul. 1974, "Sand Reclaimation Systems".

*Primary Examiner*—S. Leon Bashore
*Assistant Examiner*—Thomas M. Lithgow
*Attorney, Agent, or Firm*—Eric P. Schellin

[57] ABSTRACT

The subject matter of the invention mainly relates to the technical areas of foundry, manufacture of parts by casting metal in moulds.

The process consists in that after moulding the parts and stripping them from the moulds which were broken, during a first cycle the mixture resulting from the knock-out is recovered. This mixture being stored. This mixture is directed from the storage place to an intermediate container; then the mixture from the intermediate container is fed up to a sieve grading separator unit allowing to separate the grains or particles in several different grading batches; each one of these batches is directed to a separating table designed for separating chromite from silica; the chromite on the one hand and the silica on the other hand are recovered in containers.

This invention mainly applies to the recovery of components of different densities, especially chromite and silica.

5 Claims, 5 Drawing Figures

METHOD AND MEANS FOR TREATING FOUNDRY SANDS AND THE LIKE

The invention has for its object a method of treatment of foundry sands, more particularly in order to recover the chromite, and the invention relates also to the installation and the means for working out the method.

The object of the invention pertains more particularly to the art units of foundry, of manufacture of parts by metal casting in molds, of recovery of the mold materials or components, more particularly the chromite and silica, and also, generally, to the art unit of the separation of mixture components having different densities.

After casting the foundry pieces, when the mold is broken in order to extract the piece therefrom, this constituting the stripping off operation, there takes place also, usually, a shot blasting operation, i.e. a throwing of shot (generally iron shot) to remove the sand still adhering to the cast pieces, more particularly concerning the in-shaped forms. There is now a trend towards the recovery of the foundry sands, which are rich in chromite, the latter being a mineral species which is expensive, and incorporated with the sand of the molds, and is also mixed about the core, more particularly in steel foundry.

The method for the treatment of the foundry sands in accordance with the invention has for its object the separation and the recovery, after the castings, of the silica, the chromite and the metal shot, in order to have the possibility to use again the sand and the chromite, in repeat cycles, subject to the replacement of the loss resulting from various causes. The interest of the method in the economical, technical and rationalization plane will be clearly understood.

This method for the treatment of sands in accordance with the invention is characterized in that after the molding of the pieces and their removal from the molds which have been broken, the mixture resulting from the stripping off is recovered in a first cycle, this mixture being stored in a silo, and then forwarded from the storage silo to an intermediary silo, for instance and preferably by means of an air pulsator: the mixture contained within the silo being transferred afterwards, by gravity for instance, and with an output monitored by a regulating valve, to a granulometric separator sieve device permitting the separation of the grains or particles in several batches of various grain size. Each one of the batches of grains is forwarded to a separating table operated according to a process and with means permitting the chromite to be separated from the silica; the chromite on the one hand, and the silica on the other hand, are recovered within containers or by means of conveyors or otherwise.

In accordance with a further characteristic, the method of treatment is characterized in that after the shot blasting of the pieces removed from the molds, the mixture resulting from the shot blasting is recovered, and is stored within a silo, the mixture being then forwarded from the storage silo to an intermediary silo, for instance and preferably by means of an air pulsator, and said mixture, for instance by gravity and with a flow monitored by a regulating valve, being then passed through a magnetic drum separator which separates the particles or grains of metal, which are recovered and discharged, for instance by means of a belt conveyor; afterwards, the mixture without particles nor grains of metal is passed for instance by gravity and with a flow monitored by a valve, from the magnetic separator to a separating device with fluidized bed, permitting the grains or particles to be separated in various categories of different densities: and concerning the categories taken in the order of increasing densities: fines and dusts are collected in a general deduster; pure silica is collected by discharging it for instance by means of a belt conveyor; the category consisting of a mixture of silica and chromite is discharged, preferably by suction, then by the action of an air pulsator, to the intermediary silo of the installation for the treatment of the stripping off sand; pure chromite is collected by discharging it for instance by means of a belt conveyor.

Further characteristics of the invention are to be found in the corresponding installations for the embodiment of the processing treatment of the mixture resulting from the stripping off, and for the embodiment of the processing treatment of the mixture resulting from the shot blasting, said installation, which include the cited means, known in se or patented, corresponding to the steps of the various procedures, with the useful connections or transfers, when these installations are working in parallel, said installations being also capable of working jointly in one assembly only.

In accordance with a further characteristic, more particularly in the method of treatment for the mixture resulting from the stripping off, the invention includes a procedure of separation of the components (grains, particles for instance) of a mixture, which have different densities, this separation procedure being characterized in that the mixture is subjected to combined and simultaneous effects according to which, on the one hand, the components are fluidized by the effect of air or of a gazeous fluid under pressure across a plane or a plate ensuring a microsuperficial diffusion while on the other hand the plate or support is subjected to vibrations having an adjustable amplitude, frequency, intensity and directional effect, which are combined with an adjustable torque effect, providing the separate evacuation out of the plane or plate of each component of the mixture.

In accordance with a further characteristic and with the separating procedure of the components of different densities of a mixture, in a simultaneous manner and with concomitant effects: the mixture is brought with a suitable flow rate on a slanting support or plate of the porous type; air or some other gazeous fluid under pressure in a closed space is sent in an adjustable manner, as far as flow rate and velocity are concerned, under the plate or support providing a regular microsuperficial diffusion and the fluidization of the components, the more dense ones of which remain in contact with the plate or support, while the less dense ones are in suspension in the diffused air or gazeous fluid; vibrations of adjustable frequency and amplitude are applied onto the support or plate within the plane thereof and are combined with the effects of a mass which is at least adjustable in the intensity and in the position thereof relative to the plate or support, said mass being connected to the upper portion of the said plate or support while communicating to the latter a swinging effect tending to lift up the lower portion of the plate, said plate being mounted on its frame or other supporting assembly through the intermediately of elastic props imparting to the plate a spatial freedom in all directions, there being obtained thus in any point of the plate or support an effect giving a throwing component force towards the upper portion and beyond the more dense components in contact with the plate, while the less dense components in suspension are flowing down by the effect of gravity towards the lower portion and beyond the same, the separation and the re-gathering of the components of the same kind being provided thereby.

Further characteristics are to be found in the installation and the means for working out the separating procedure of the components of different densities of a mixture.

These and still further characteristics will be apparent from the following description.

The object of the invention is set forth more clearly with reference to the attached drawings, without however being limited thereby. In the drawings:

FIG. 1 shows in a purely schematic manner, and in parallel, the installation corresponding to the method of treatment for the mixture resulting from the stripping off and the installation corresponding to the method of treatment for the mixture resulting from the shot blasting, and it will be noted that although each one of the installations can be mounted and used separately, their use is contemplated here in one installation unit only, together with the suitable connections and transfers between the two aforesaid installations;

To make the object of the invention more concrete, the invention will be described now in the non-limiting forms of embodiment and installations thereof for working out the described methods in accordance with the invention.

Figure 1:
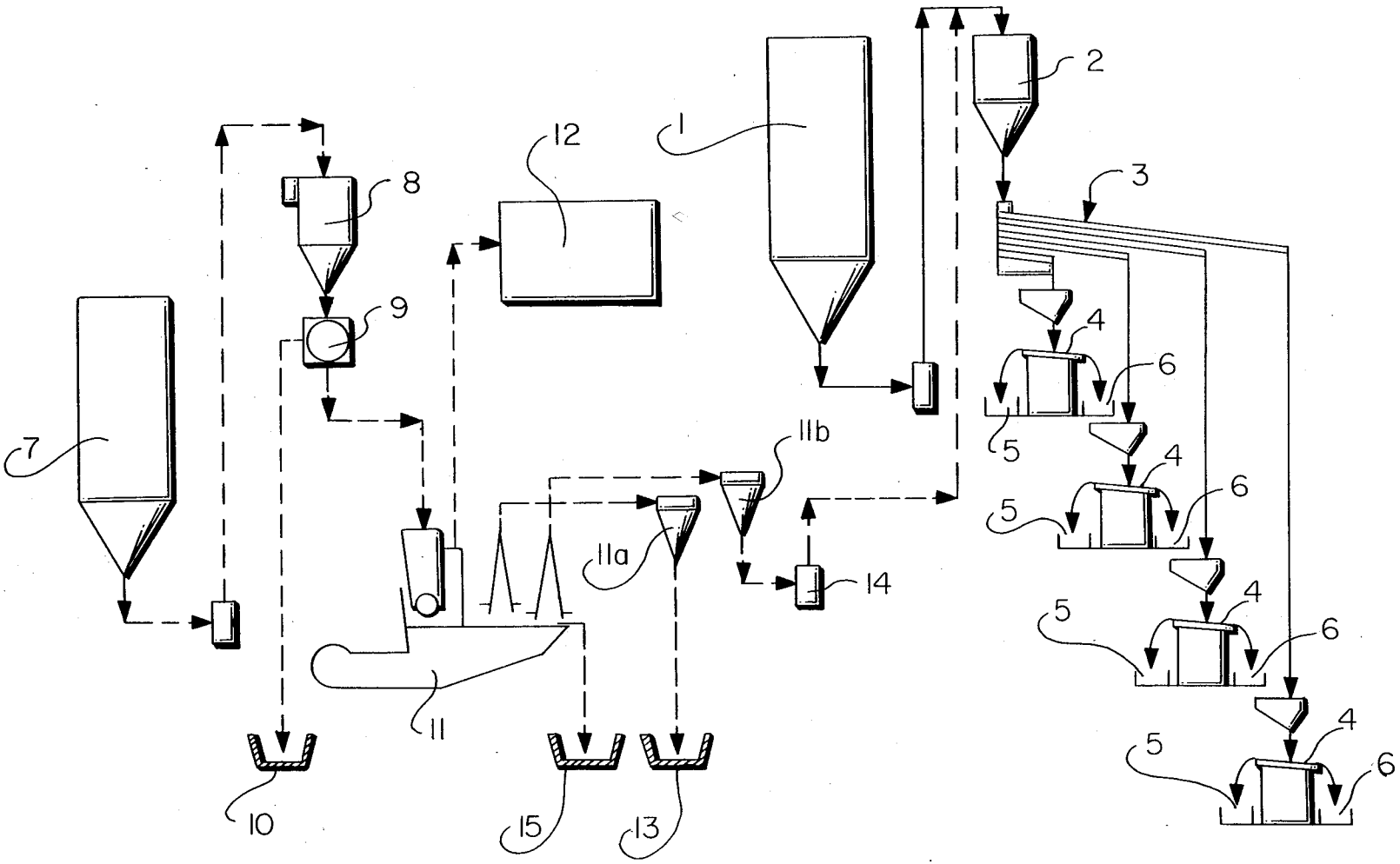
Figure 3:
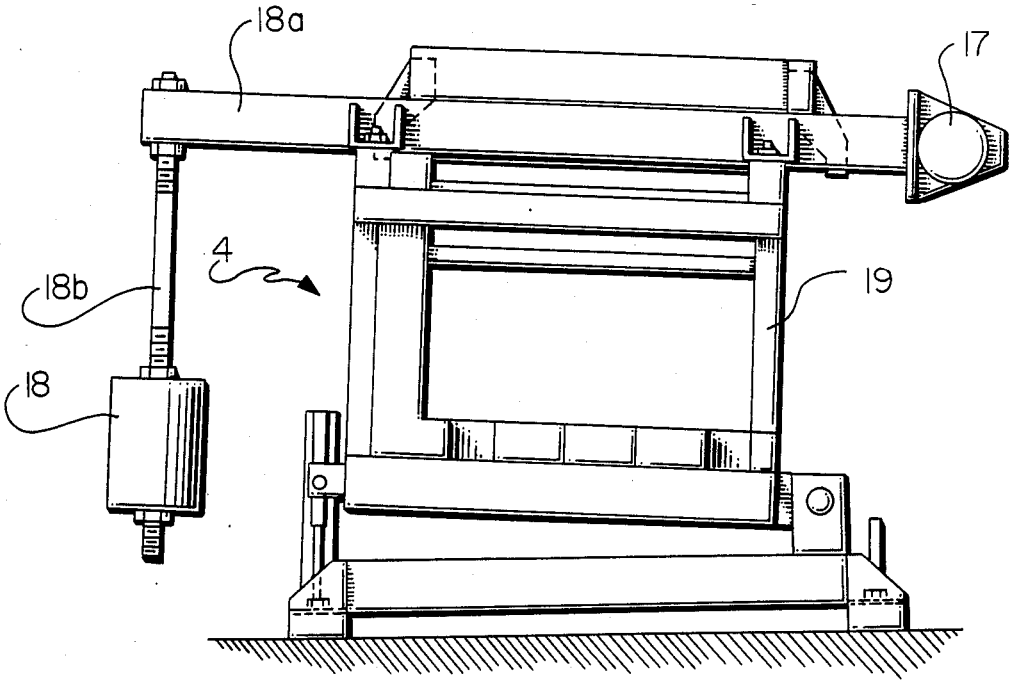
FIGS. 3, 4 and 5 are corresponding views, respectively, an elevation view, a side view and a plan view, which show a form of embodiment of the separating table.
Figure 4:
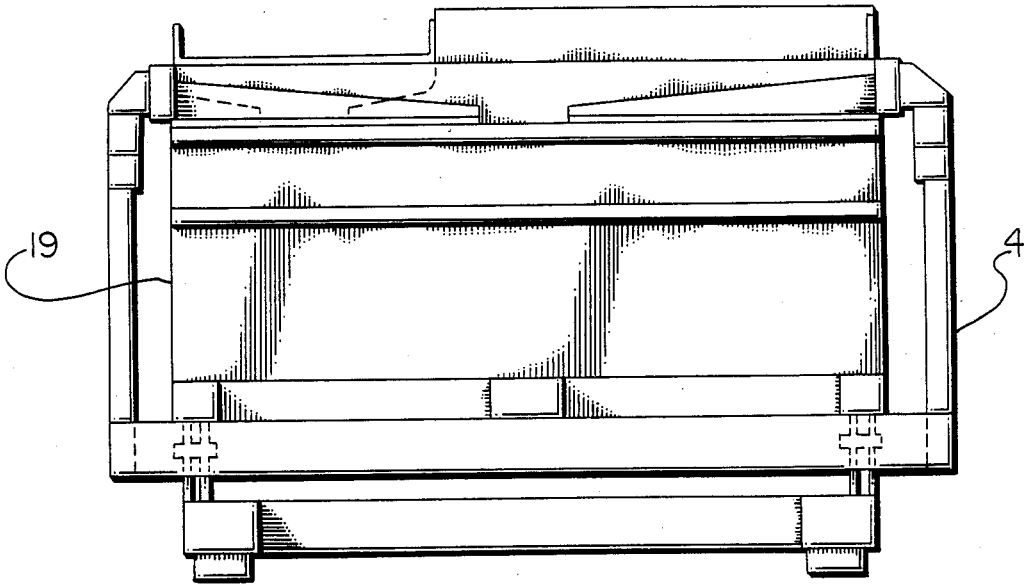
Figure 5:
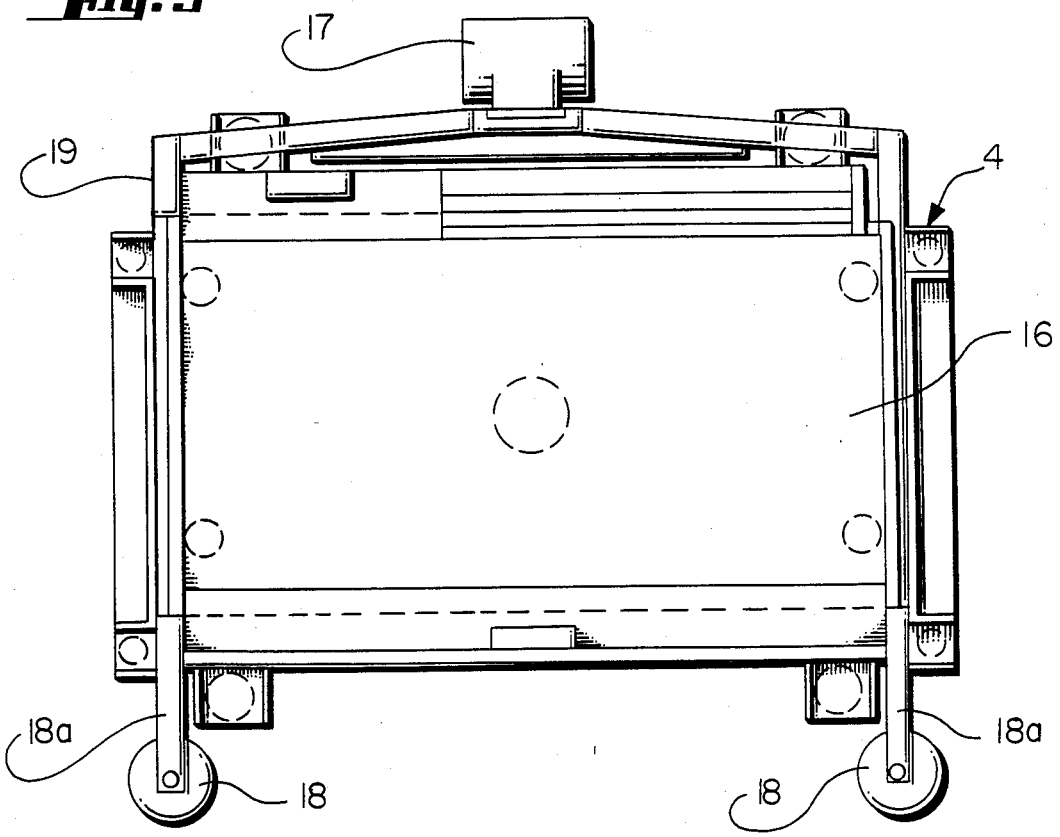

Concerning the installation corresponding to the method of treatment for the mixture resulting from the stripping off, there may be seen in FIG. 1, in a diagrammatic form which is sufficient for understanding and working out the method, a general storage silo (1) into which the mixture is sent, this mixture being forwarded thereafter to an intermediary silo (2) by the effect of any well-known means, and more particularly by the effect of an air pulsator (not shown). The mixture to be sorted out, the flow rate of which is monitored by a regulating valve (not shown) is then passed, for instance by gravity in the example illustrated, upon a granulometric separator (3) which separates the grains or particles of the mixture in a plurality of batches of different grain size, for instance five different batches ($+800\mu+400\mu+250\mu+140\mu-140\mu$). Each one of these batches is forwarded to a special separating table (4) (FIGS. 3, 4 and 5). Therefore, there is a separating table by batch or category, and each table, for each batch, permits the chromite to be separated from silica.

As the case may be, these separating tables (4) could be made in any known manner and in accordance with any known method, for instance by using grids or sieves provided with suitably sized openings, or in accordance with the characteristic arrangements which have formed the subject matter of the French Pat. Nos. 2240053, 2241458, 2430265. Lastly, in a known manner for the separating tables (4), and preferably, silica is recovered on the one hand, and chromite on the other hand, each one being received into containers, discharge channels, or still, according to the example of the drawings, upon belt conveyors (5 and 6).

Concerning the installation corresponding to the method of treatment for the mixture resulting from the shot blasting, this installation is also illustrated in a schematic manner in FIG. 1, and there may be seen therein the storage silo (7) which receives the mixture resulting from the shot blasting, said mixture, from this silo, being forwarded to an intermediary silo (8) by any known means, using for instance an air pulsator. The flow rate of the mixture to be sorted out is monitored by a regulating valve to be passed, by the effect of gravity, from the silo (8) to a magnetic drum separator (9) of a type known in se, which eliminates the magnetic particles contained within the mixture, said magnetic particles being discharged for instance by means of a belt conveyor (10).

The mixture without particles, nor grains of metal, is then directed to a separating device (11) with fluidized bed.

The separator (11) provides the separation of the four different products, which are:

fines and dusts collected by a general deduster (12)

pure silica sucked up by a sucker (11*a*), which is discharged for instance by means of a carpet (13);

a mixture consisting of silica and chromite, sucked up by a second sucker (11*b*) of the separating device (11), which is directed by means of an air pulsator (14) towards the stripping off sand circuit;

pure chromite discharged by a carpet (15) or conveyor belt.

In accordance with a particularly important characteristic of the invention, a process for the preparation of the components (chromite and silica) which have different densities is included in the method for the treatment of the mixture resulting from the stripping off.

For this purpose, the mixture is subjected to combined and simultaneous effects according to which, on the one hand, the components are fluidized by the effect of the air or of a gaseous fluid under pressure through a slanting plane or plate (16) of the separating table (4), said plate being formed to provide in a known manner a microsuperficial diffusion. One of the transverse ends of the plate (16), on the lowest side, are made dependent on a vibratory device (17), while the other end is made dependant on an adjustable assembly of masses (18). The masses (18) are mounted projecting from the active portion of the plate and supported by arms (18*a*) mounted within the extension of and beyond the lateral sides of said plate. The result is that the plate can be submitted to vibrations of adjustable frequency, amplitude, intensity and directional effect, which are combined with an adjustable torque effect, in order to provide the separate discharge, out of the plate, of each component, chromite and silica, of the mixture.

The diffusor plate (16) is mounted by any well-known and suitable means, in a slanting and adjustable manner on the supporting framework (19) of the table (4), and at each one of its top and bottom transversal ends, this plate is made dependant more particularly on blocks or elements (20) with possibility of elastic deformation. Underneath the plate (16) is formed a volume closed by a flexible diaphragm (22). An air generator (23) or some other means opens in the bottom of the sealed volume (22) in order to send air under pressure in the interior of said volume, for fluidizing the components, chromite and silica, disposed on the plate.

Figure 2:
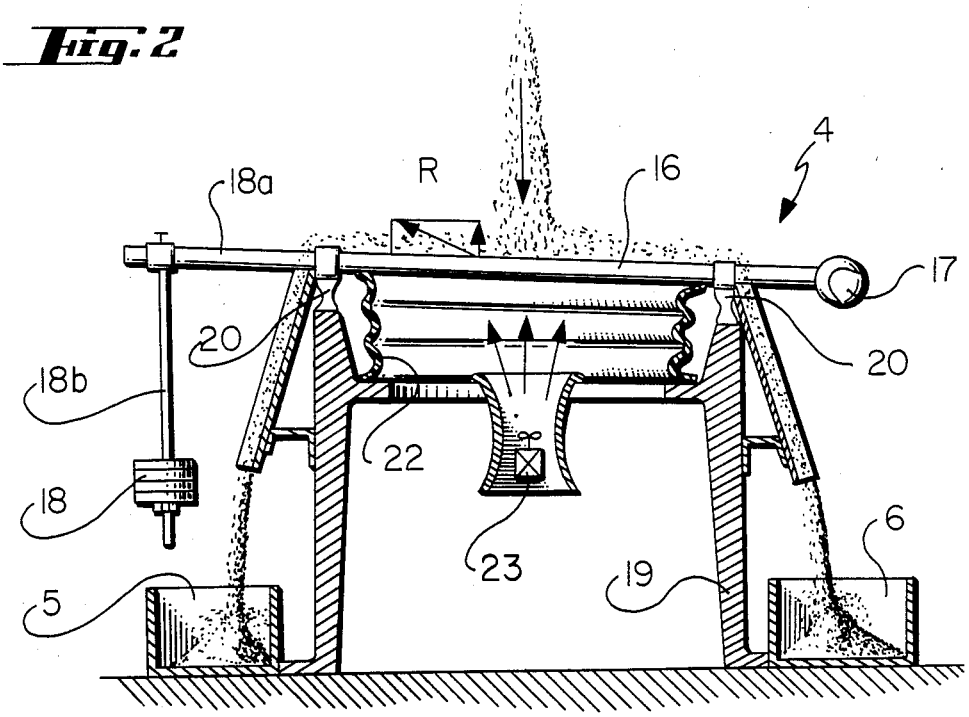
FIG. 2 illustrates in a general view of diagrammatical character the separating table with slanting plate, embodying the separating procedure of the components of different densities of a mixture.

There has been illustrated in FIGS. 3, 4 and 5 a form of embodiment of the separating table corresponding to the operational principle shown in FIG. 2.

In accordance with the method for separating the components of different densities of a mixture, in a simultaneous manner with concomitant effects, the mixture is brought with a suitable flow rate onto the slanting plate (16) of porous type. In the example of the invention, the chromite makes up the dense products, while silica forms the light or less dense products.

By means of the generator (23), and in an adjustable manner as to flow rate and velocity, air or some other gaseous fluid is sent under the supporting plate (16) which provides a regular microsuperficial diffusion and the fluidization of the components, the more dense of which (chromite) remain in contact with said plate (16), while the less dense (silica) are in suspension within the diffused air or gazeous fluid.

The plate (16) is subjected through the vibratory device (17) to vibrations of adjustable frequency and amplitude. These vibrations are combined with the effects of the adjustable masses (18), both in intensity and in position relative to the plate (16). The masses can be adjusted vertically on a vertical element (18*b*) of the supporting arm (18*a*) and/or moved longitudinally relative to said arms. As all of the masses, (18) are connected to the top portion of the plate (16), they communicate to the latter, in combination with the amplitudes of the vibrator (17), a swinging effect tending to cause the lower portion of the plate to be raised. The elastic abutments (20) impart to the plate a spatial freedom in all directions, the flexible diaphragm (22) providing an air sealing between the plate (16) and the housing for the support of the separating table (4).

It will be more particularly noted that the mobility of the plate is achieved with practically no efforts, as the plate is finally supported by air cushions the pressure of which compensates very nearly the masses.

The result is therefore that the combination of the vibrator and of the adjustable masses creates in all points of the plate a resultant $\vec{R}$ directed towards the top portion of said plate (16), the more dense products or components (chromite) in contact with the plate being thus permitted to ascend.

Therefore, it will be appreciated that under the effect of the ascending jets of air, or other gazeous fluid, sent into the sealed enclosure (22), the products to be separated are fluidized by the plate (16) owing to the conformation thereof, in such a manner that the dense products (chromite) remain in contact with the sole of the diffusor plate (16), while the lighter products (silica) remain in suspension. The vibratory mentions imparted to the plate (16), in combination with the masses (18), tend to cause the dense components overflowing in the upper portion of the plate to ascend, while the less dense components in suspension, which are not subjected to the vibratory motions, are going down by gravity, to overflow at the other end, in the lower portion of the plate (16) (FIG. 2).

It will be noted that the swinging process of the plate, superposed to the longitudinal vibrations, accelerates the ascending flow of the heavy products, the masses (18), being diposed beyond the supporting system of the plate, making it possible to prevent the creation of vibration nodes on the side of said plate. The nodal air is thrown back beyond the active working portion of the plate.

It will be appreciated that the longitudinal swinging torque created by the adjustable masses, under the effect of the vibrations generated by the vibratory device, is likewise capable of causing the heavy products in contact with the table to be advanced by a ballistic process. As a matter of fact, under a very substantial acceleration following very nearly the resultant $\vec{R}$, the grain of chromite is capable of being unstuck from the plate and to fall back when said plate has performed its return motion, and so on.

We claim:

1. In a method of treatment of foundry sands to recover the chromite therein, said sands resulting from the manufacture of metal castings in sand molds, after the manufacture of the castings the molds are broken off said castings to recover chromite from said sand molds, the improvement comprising as a first cycle, recovering and storing in a silo a particle mixture of chromite and silica, forwarding said mixture to a first intermediary silo, passing said mixture from said intermediary silo to a granulometric separator device, said separator device spearating the particle mixture into a plurality of batches of different particle sizes, bringing each of said batches onto different pneumatic stratifying devices, separating the higher density chromite from the lower density silica on each stratifying device, and recovering the chromite and the silica separately from each stratifying device.

2. The method of claim 1, wherein said mixture is forwarded to said intermediary silo by means of air pulsation using a regulating valve to monitor the flow rate of said mixture, and the mixture is passed by gravity to the granulometric separating device, and conveyor belts are used to separately recover chromite and silica.

3. In a method of treatment of foundry sands to recover the chromite therein, said sands resulting from the manufacture of metal castings in sand molds, the sands being derived from both the stripping of the sand mold from the casing and the shot blasting of the casting, the improvement comprising as a first cycle, recovering and storing in a silo a first particle mixture which is comprised of magnetic particles, dust, chromite and silica, forwarding said mixture to a first intermediary silo, passing said mixture from the intermediary silo to a magnetic drum separator device to eliminate said magnetic particles from said mixture to yield a nonmagnetic mixture, passing said nonmagnetic mixture from said magnetic separator to a fluidized bed separating device which separates the nonmagnetic mixture into a plurality of categories of different densities, said categories comprising dusts, a mixture of silica and chromite, and pure chromite; forwarding said mixture of chromite and silica to a second intermediary silo, passing said chromite and silica mixture to a granulometric separator device which separates the chromite and silica mixture into a plurality of batches of different particle sizes, bringing each of said batches onto different pneumatic stratifying devices for separating the chromite from the silica, recovering the chromite and the silica separately from each stratifying device.

4. The method of claim 3, wherein said chromite and silica mixture is forwarded to said first intermediary silo by means of an air pulsator, the flow rate of the first particle mixture from said first intermediary silo to said magnetic drum separating device is monitored by a central regulating valve in order to pass the first particle mixture under the action of gravity from said first intermediary silo to said magnetic drum separator device which eliminates the magnetic particles contained in the mixture, said magnetic particles being collected and discharged by means of a belt conveyor.

5. The method of claim 4, wherein the dusts from the fluidized bed separating device are fed to a deduster, the silica and chromite mixture from the fluidized bed separating device are sucked in by a sucking device, whereafter said mixture is directed toward the second intermediary silo.

* * * * *